US010154545B2

(12) United States Patent
Christiansen et al.

(10) Patent No.: US 10,154,545 B2
(45) Date of Patent: Dec. 11, 2018

(54) INDUCTION HOB AND METHOD FOR OPERATING AN INDUCTION HOB

(71) Applicant: Electrolux Appliances Aktiebolag, Stockholm (SE)

(72) Inventors: Svend Erik Christiansen, Forli (IT); Laurent Jeanneteau, Forli (IT); Alex Viroli, Forli (IT); Luca Zannoni, Cesena (IT)

(73) Assignee: Electrolux Appliances Aktiebolag, Stockholm (SE)

( * ) Notice: Subject to any disclaimer, the term of this patent is extended or adjusted under 35 U.S.C. 154(b) by 345 days.

(21) Appl. No.: 14/901,907

(22) PCT Filed: Jun. 30, 2014

(86) PCT No.: PCT/EP2014/063788

§ 371 (c)(1),
(2) Date: Dec. 29, 2015

(87) PCT Pub. No.: WO2015/018565

PCT Pub. Date: Feb. 12, 2015

(65) Prior Publication Data

US 2016/0381735 A1 Dec. 29, 2016

(30) Foreign Application Priority Data

Aug. 5, 2013 (EP) ..... 13179202

(51) Int. Cl.
*H05B 6/06* (2006.01)
*H05B 6/08* (2006.01)

(52) U.S. Cl.
CPC ..... *H05B 6/065* (2013.01); *H05B 6/08* (2013.01)

(58) Field of Classification Search
CPC ..... H05B 2213/07; H05B 6/06; H05B 6/062; H05B 6/065; H05B 6/129
(Continued)

(56) References Cited

U.S. PATENT DOCUMENTS 7,910,865 B2 * 3/2011 Haag ..... H05B 6/065
2007/0135037 A1 * 6/2007 Barragan Perez ..... H02M 1/44 455/7

(Continued)

FOREIGN PATENT DOCUMENTS

CN 102256401 A 11/2011
EP 0861015 A2 8/1998

(Continued)

OTHER PUBLICATIONS

International Search Report for PCT/EP2014/063788, dated Oct. 6, 2014, 2 pages.

*Primary Examiner* — Tu B Hoang
*Assistant Examiner* — Vy Nguyen
(74) *Attorney, Agent, or Firm* — Pearne & Gordon LLP

(57) ABSTRACT

An induction hob including a first heating region with a first induction coil and a second heating region with a second induction coil is provided. First and second resonant converters drive an AC current through the first and second induction coils. The first and second resonant converters form a half-bridge resonant converter that is continuously driven such that a direction of current flow through the first induction coil and the second induction coil is alternating. The half-bridge resonant converter controls the output power of the first and second heating regions by varying the frequency of the AC current through the respective induction coil. The first and second resonant converters have different resonance frequencies such that the resonance frequency of (Continued)

the first resonant converter is at least 1.4 times higher than the resonance frequency of the second resonant converter.

15 Claims, 2 Drawing Sheets

(58) Field of Classification Search
USPC ..... 219/620, 661, 667, 660, 506, 624, 626, 219/627, 112; 374/E11.009, 117; 307/112
See application file for complete search history.

(56) References Cited

U.S. PATENT DOCUMENTS

2010/0237065 A1* 9/2010 Cho ..... H05B 3/12 219/624
2011/0079591 A1* 4/2011 Parachini ..... H05B 6/065 219/620
2013/0284722 A1* 10/2013 Viroli ..... H05B 6/065 219/622

FOREIGN PATENT DOCUMENTS

JP 2005149736 A 6/2005
JP 2012230874 A 11/2012

* cited by examiner

INDUCTION HOB AND METHOD FOR OPERATING AN INDUCTION HOB

The present invention relates generally to the field of induction hobs. More specifically, the present invention is related to an induction hob adapted to suppress audible interference noise.

BACKGROUND OF THE INVENTION

Induction hobs for preparing food are well known in prior art. Induction hobs typically comprise at least one induction heater which is associated with at least one induction coil. For heating a piece of cookware placed on the induction hob, the induction coil is coupled with electronic driving means for driving an AC current through the induction coil. Said AC current generates a time verifying magnetic field. Due to the inductive coupling between the inductor coil and the piece of cookware placed on the induction hob, the magnetic field generated by the inductor coil causes eddy currents circulating in the piece of cookware. The presence of said eddy currents generates heat within the piece of cookware due to the electrical resistance of said piece of cookware.

Typically, the electric driving means generate AC currents at frequencies outside the frequency spectrum audible for the human ear. In this way the generation of audible sounds during the operation of the induction hob is avoided. However, induction coils placed in close proximity to each other may even generate audible noise due to interference effects. If the first induction coil is driven at the first frequency and the adjacent second induction coil is driven at a second frequency, an interference frequency may be generated resulting from the difference of the first and second frequencies.

The output power of induction hops is typically changed by adapting the frequency of the AC current driven through the induction coils. Thus, the frequency difference of the AC currents of adjacent induction coils is changing according to the user's power request at the respective induction heaters.

Document EP 2 469 970 A2 discloses a cooking device with several induction heaters. The induction heaters are coupled with driving means for powering the induction heaters. In order to avoid interference noise and achieve a certain output power at the induction heaters, the first induction heater is driven by an AC current with a constant frequency wherein the second induction heater is driven by an AC current with alternating frequencies. Thereby the output power of the second induction heater is also alternating.

A drawback of the known induction hob is that interference noise is not suppressed sufficiently. In addition, the alternation of output power leads to flicker at the mains supply.

SUMMARY OF THE INVENTION

It is an objective of the embodiments of the invention to provide effective means for suppressing interference noise at induction hobs with at least two induction heaters without creating any flicker at the mains supply. The objective is solved by the features of the independent claim. Preferred embodiments are given in the dependent claims. If not explicitly indicated otherwise, embodiments of the invention can be freely combined with each other.

According to an aspect of the invention, the invention relates to an induction hob comprising at least two induction heaters, each induction heater associated with at least one induction coil, wherein a first induction heater is associated with a first type of electronic driving means comprising a first induction coil and being adapted for driving an AC current through said first induction coil of the first induction heater, wherein the second induction heater is associated with a second type of electronic driving means comprising a second induction coil and being adapted for driving an AC current through said second induction coil of the second induction heater and wherein the electronic driving means are adapted to control the output power of the induction heaters by varying the frequency of the AC current through the respective induction coil. Each electronic driving means is adapted to cause a constant electric power flow through the induction coil and the electronic driving means of the first and second type have different resonance frequencies such that the resonance frequency of the first type of electronic driving means is at least 1.4 times higher than the resonance frequency of the second type of electronic driving means.

Advantageously, said spreading of resonance frequencies leads to improved noise suppression due to interference effects even if the induction heaters are powered by a constant, i.e. non-alternating output power. Thereby flicker at the mains supply can be avoided.

According to preferred embodiments, the frequency ranges of the first and second type of electronic driving means are different to each other and/or do not overlap. Thereby the output power of the first and second induction heaters can be adapted according to the user's demand in a broad range without generating any interference noise.

According to preferred embodiments, a frequency difference of at least 20 kHz between the frequency of the AC current generated by the first type of electronic driving means operating the first induction heater at maximum power and the frequency of the AC current generated by the second type of electronic driving means operating the second induction heater at a power of 40% of the maximum power of the first induction heater is provided. Said spreading of frequency spectra leads to a broad flexibility in adapting the output power of the induction heaters in typical ranges without the appearance of any interference noise.

According to preferred embodiments, a frequency difference of at least 20 kHz between the frequency of the AC current generated by the first type of electronic driving means operating the first induction heater at maximum power and the frequency of the AC current generated by the second type of electronic driving means operating the second induction heater at a minimum power is provided. In this way, the generation of interference noise can be avoided in the whole range of operating conditions, i.e. demanded output power of the first and second induction heaters.

According to preferred embodiments, a control unit is provided with a software algorithm for keeping the frequency difference of the AC currents powering the first and second induction heaters out of the audible range. Thereby even in adverse operating conditions, in which the frequency difference falls within the audible spectrum, an interference noise may be avoided.

According to preferred embodiments, the first and second types of electronic driving means are operated at different phases of the mains supply. Due to the constant or essentially constant output power of each induction heater, said induction heaters can be powered at different phases of the mains supply because no flicker is created. So, there is also no need for an equalisation of power variations on a common phase of the mains supply.

According to preferred embodiments, the first and second induction heaters are located next to each other in direct proximity.

According to preferred embodiments, the output power of the first and/or second induction heater operated at resonance frequency is 4-15 times higher than the output power of the first and/or second induction heater operated at maximum frequency. In addition, all interim values of said range are possible. Thereby, the output power of the induction heaters can be varied in a broad range in order to meet the user's power demand.

According to preferred embodiments, the induction hob comprises at least three induction heaters each powered by different types of electronic driving means. Said electronic driving means may be adapted such that the frequency spans effected by the respective electronic driving means are spaced sufficiently according to the aforementioned embodiments.

According to a second aspect, the invention relates to a method for operating an induction hob comprising at least two induction heaters, each induction heater associated with at least one induction coil, wherein the first induction heater is associated with a first type of electronic driving means comprising a first induction coil and being adapted for driving an AC current through said first induction coil of the first induction heater, wherein the second induction heater is associated with a second type of electronic driving means comprising a second induction coil and being adapted for driving an AC current through said second induction coil of the second induction heater and wherein the output power of the induction heaters is controlled by varying the frequency of the AC current through the respective induction coil. Each electronic driving means is operated such that a constant electric power flow through the induction coil is provided and the electronic driving means of the first and second type have different resonance frequencies such that the resonance frequency of the first type of electronic driving means is at least 1.4 times higher than the resonance frequency of the second type of electronic driving means.

The term "essentially" or "approximately" as used in the invention means deviations from the exact value by +/−10%, preferably by +/−5% and/or deviations in the form of changes that are insignificant for the function.

BRIEF DESCRIPTION OF THE DRAWINGS

The various aspects of the invention, including its particular features and advantages, will be readily understood from the following detailed description and the accompanying drawings, in which.

DETAILED DESCRIPTION OF PREFERRED EMBODIMENTS

Figure 1:
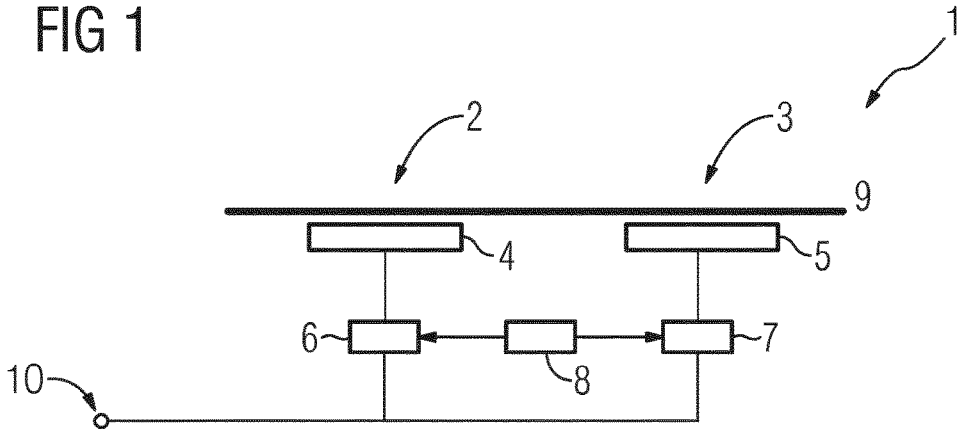
FIG. 1 shows a schematic view of an induction hob according to the current invention.

The present invention will now be described more fully with reference to the accompanying drawings, in which example embodiments are shown. However, this invention should not be construed as limited to the embodiments set forth herein. Throughout the following description similar reference numerals have been used to denote similar elements, parts, items or features, when applicable.

FIG. 1 shows a schematic illustration of an induction hob 1 according to the invention. The induction hob 1 comprises at least two induction heaters, namely a first induction heater 2 and a second induction heater 3 preferably provided at a common hob plate 9. Beneath the hop plate 9 two induction coils 4, 5 are arranged, wherein the first induction coil 4 is associated with the first induction heater 2 and the second induction coil 5 is associated with the second induction heater 3. The first induction coil 4 is coupled with first electronic driving means 6 of a first type, wherein said electronic driving means 6 are coupled with a mains supply 10. Similarly, the second induction coil 5 is coupled with second electronic driving means 7 of a second type, wherein said electronic driving means 7 are coupled with the mains supply 10. Furthermore, a control unit is provided for controlling the operation of the electronic driving means 6, 7, specifically for adjusting the output power of the induction coils 4, 5.

In order to avoid audible noise arising from interferences between the frequency of the AC current provided by the first electronic driving means 6 in order to power the first induction coil 4 and the frequency of the AC current provided by the second electronic driving means 7 in order to power the second induction coil 5, the electronic driving means 6, 7 are configured differently in an asymmetric way, i.e. the frequency span of the AC current provided to the first induction coil 4 and the frequency span of the AC current provided to the second induction coil 5 are different. Preferably, the electronic driving means 6, 7 are configured such that the frequency spans of the AC currents powering the first and second induction coils 4, 5 do not overlap. Thereby the output power of the first and second induction heaters 3 may be adjusted by changing the frequency of the AC currents powering the first and second induction coils 4, 5 according to a user demand wherein the frequencies are separated such that audible interference noise is avoided. Advantageously, the demanded output power of the induction heaters 2, 3 is obtained only by adjusting the frequency provided to the induction coils 4, 5 without varying the electrical power stepwise between different power levels in order to achieve a certain mean power level.

Preferably, the electronic driving means 6, 7 form a resonant converter in association with the respective induction coils 4, 5 which provides at the output a square voltage waveform that is applied to a resonating circuit including the induction coil 4, 5 itself and one or more capacitors.

Figure 2:
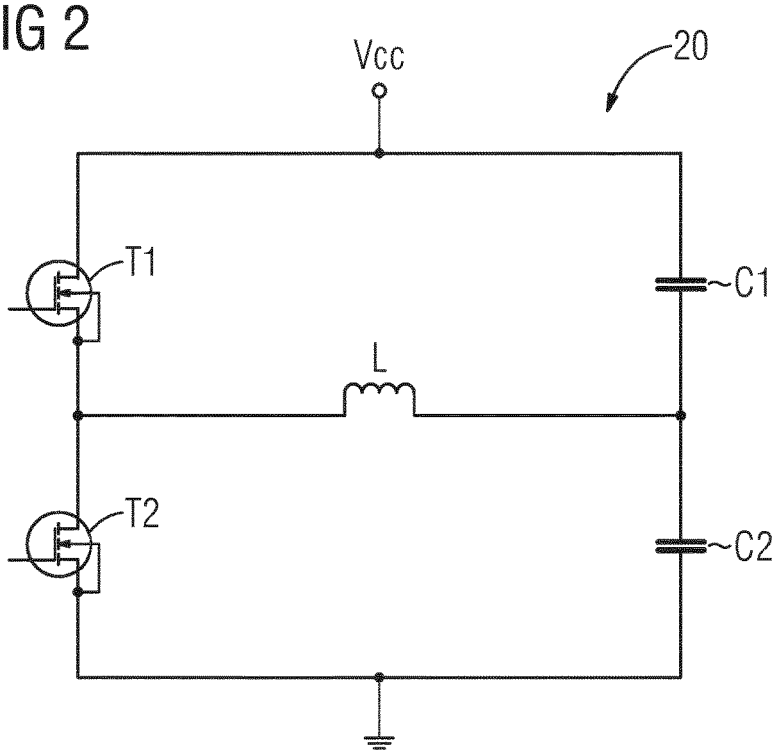
FIG. 2 shows a half bridge converter for powering the induction coils.

FIG. 2 shows a schematic view of a resonant half-bridge converter 20 that may be used for powering the induction coils 4, 5. The resonant half-bridge converter 20 comprises two switching circuits formed by the transistors T1, T2 and a resonant circuit formed by the capacitors C1, C2 and the inductor L which is constituted by the induction coil 4, respectively, the induction coil 5. The resonant circuit is continuously driven by the transistors T1, T2 such, that the direction of current flow through the induction coil 4, 5 is alternating. The resulting AC current in the induction coil 4, 5 provides a time-varying electromagnetic field required for heating a piece of cookware located at the induction heater 2, 3 by means of an inductive coupling between the induction coil 4, 5 and the piece of cookware. Said piece of cookware may be constituted by a pot, a pan, a casserole or other cooking utensils. Typically, the power transfer between the induction coil 4, 5 and the piece of cookware to be heated depends on the frequency of the AC current flowing through the induction coil 4, 5.

In order to avoid audible noise, the resonant frequencies of the resonant circuits formed within the electronic driving means 6, 7 are different. The resonant frequency $f_{res}$ of the half bridge converter shown in FIG. 2 is calculated as follows:

$$f_{res} = \frac{1}{2\pi\sqrt{L(C1 + C2)}};$$

wherein L is the inductance value of the inductor coil 4, 5, and C1 and C2 are the capacitance values of the capacitors C1, C2. The resonant frequencies of the first and second type of electronic driving means 6, 7 differ at least by a factor of 1.4, i.e. the resonant frequency of the first type of electronic driving means 6 is at least 1.4 times higher than the resonant frequency of the second type of electronic driving means 7 ($f_{res}$(Type1)=$f_{res}$(Type2)*1,4). Thereby a spread of the frequency spans for powering the first and second induction coils 4, 5 is obtained, which ensures that the output power of the first and second induction heater can be adapted by changing the frequency of the AC current flowing through the respective induction coil 4, 5 without generating audible noise due to interferences.

Figure 3:
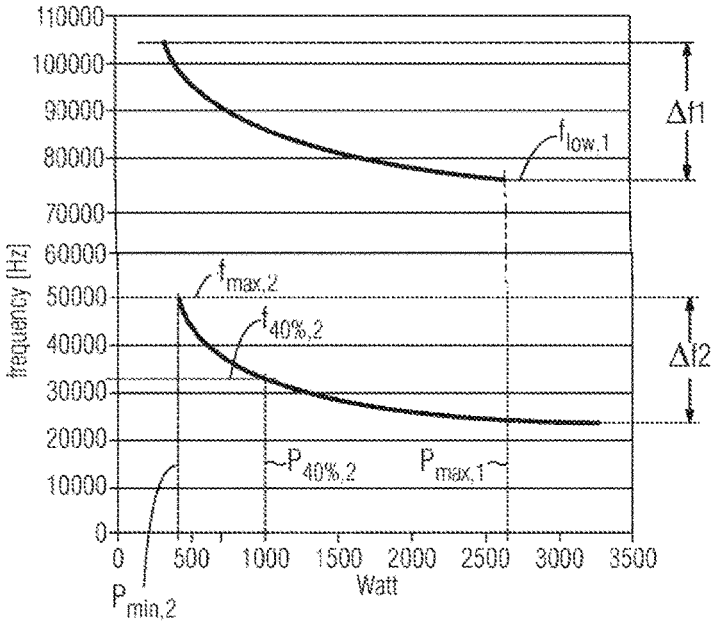
FIG. 3 shows power-frequency graphs for two different types of electronic diving means.

FIG. 3 shows the frequency dependency of the output power of both types of induction heaters 2, 3. The abscissa shows the output power of the induction heaters 2, 3 and the ordinate shows the respective frequency values. The upper diagram may be associated with the first induction heater 2 driven by the first type of electronic driving means 6. Accordingly, the lower diagram may be associated with the second induction heater 3 driven by the second type of electronic driving means 7. Preferably, the resonant circuits formed within the electronic driving means 6, 7 are dimensioned such that the frequency range Δf1 of the electronic driving means 6 of the first type and the frequency range Δf2 of the electronic driving means 7 of the second type do not overlap. This is mainly achieved by the appropriate dimensioning of the resonant frequency, wherein the resonant frequency of the first type of electronic driving means 6 is at least 1.4 times higher than the resonant frequency of the second type of electronic driving means 7.

According to preferred embodiments, the resonant circuits formed within the electronic driving means 6, 7 are dimensioned such that the frequency difference between the lowest frequency $f_{low,1}$ at which the first type of electronic diving means 6 provides the maximum output power $P_{max,1}$ and the maximum frequency $f_{max,2}$, at which the second type of electronic diving means 7 provides the minimum output power $P_{min,2}$ is at least 20 kHz. Thereby, the frequency bands of the first and second type of electronic driving means 6, 7 are separated such, that even operating the electronic driving means 6, 7 in the adverse border areas, the frequency difference is sufficient for avoiding audible interferences.

According to other embodiments, the frequency bands are dimensioned such that the frequency difference between the lowest frequency $f_{low,1}$ of the AC current generated by the first type of electronic driving means 6 operating the first induction heater 2 at maximum power $P_{max,1}$ and the frequency $f_{40\%,2}$ of the AC current generated by the second type of electronic driving means 7 operating the second induction heater 3 at the power $P_{40\%,2}$ of 40% of maximum power $P_{max,2}$ is at least 20 kHz. Thereby, the frequency spans provided by the first and second type of electronic driving means 6, 7 are separated such, that audible interferences are avoided in the majority of operating conditions.

In order to avoid audible interferences even in those cases, in which the first and second induction heaters 2, 3 are operated in adverse border areas, the control unit may comprise a software algorithm for keeping the frequency difference of the AC currents powering the first and second induction heaters out of the audible range.

By powering the induction heaters 2, 3 with a constant electric power flow without any abrupt or alternating power variations and obtaining the adaption of output power only by varying the frequency of the AC current through the induction coils 4, 5, no flicker at the mains supply 10 is arising. Thereby it is even possible to operate the induction heaters 2, 3 at different phases of the mains supply 10.

Figure 4:
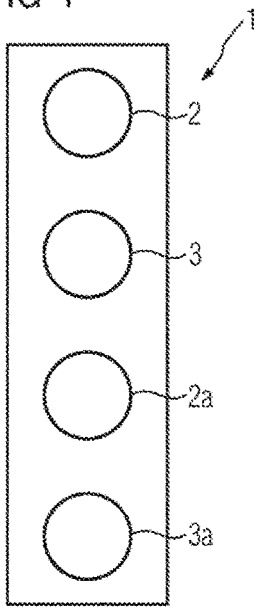
FIG. 4 shows a linear arrangement of two pairs of induction heaters in an asymmetric configuration.
Figure 5:
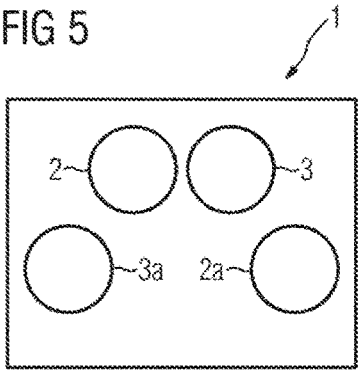
FIG. 5 shows a rectangular arrangement of two pairs of induction heaters in an asymmetric configuration.

FIGS. 4 and 5 shows different arrangements of induction heaters 2, 2*a*, 3, 3*a* at an induction hob 1. FIG. 4 shows a serial arrangement of four induction heaters 2, 2*a*, 3, 3*a*, i.e. the induction heaters are arranged linearly. Said four induction heaters 2, 2*a*, 3, 3*a* are powered by two different types of electronic driving means 6, 7, wherein the induction heaters 2, 2*a* are powered by a common first type of electronic driving means 6 and the induction heaters 3, 3*a* are powered by a common second type of electronic driving means 7. The arrangement is such, that the induction heaters 2, 2*a*, 3, 3*a* driven by different types of electronic driving means 6, 7 are arranged next to each other in direct proximity. For example, the induction heater 3 is surrounded by two induction heaters 2, 2*a* which are driven by first type of electronic driving means 6, wherein the induction heater 3 itself is driven by a second type of electronic driving means 7. Thereby, the induction heaters driven by the same type of electronic driving means are separated such, that interferences caused by of the same or overlapping frequency bands are avoided.

FIG. 5 shows a different kind of arrangement of induction heaters 2, 2*a*, 3, 3*a* driven by two different types of electronic driving means 6, 7. The induction heaters 2, 2*a*, 3, 3*a* are arranged in a rectangular arrangement wherein the induction heaters 2, 2*a*, 3, 3*a* driven by the same type of electronic driving means 6, 7 are arranged diagonally. Preferably, the horizontal distance the two pairs of induction heaters is different in order to increase the diagonal distance of the induction heaters 2, 2*a*, 3, 3*a* driven by the same type of electronic driving means 6, 7.

It is worth mentioning, that the invention is not restricted to the usage of only two types of electronic driving means. So, the invention also covers induction hobs 1 with a plurality of induction heaters wherein each induction heater is powered by a different type of electronic driving means or groups of induction heaters are powered by different types of electronic driving means.

LIST OF REFERENCE NUMERALS

1 induction hob
2, 2*a* first induction heater
3, 3*a* second induction heater
4 first induction coil
5 second induction coil
6 electronic driving means (first type)
7 electronic driving means (second type)
8 control unit
9 hob plate
10 mains supply
20 half-bridge converter
Δf1 first frequency range Δf2 second frequency range $f_{low,1}$ lowest freq. of first type of electronic driving means $f_{max,2}$ max. freq. of second type of electronic driving means $f_{40\%,2}$ frequency for providing 40% output power $P_{max,1}$ max. output power of 1st type of electronic driving means $P_{min,2}$ min. output power of 2nd type of electronic driving means $P_{40\%,2}$ 40% output power of 2nd type of electronic driving means C1 Capacity C2 Capacity L Inductor T1 Transistor T2 Transistor

The invention claimed is:

1. An induction hob comprising:

a first heating region comprising a first induction coil, a second heating region comprising a second induction coil, a first resonant converter configured to drive a first AC current through the first induction coil, and a second resonant converter configured to drive a second AC current through the second induction coil, wherein:

the first resonant converter and the second resonant converter form a half-bridge resonant converter that causes a constant electric power flow through the first induction coil and the second induction coil, the half-bridge resonant converter is continuously driven such that a direction of current flow through the first induction coil and the second induction coil is alternating, the half-bridge resonant converter controls an output power of the first and second heating regions by varying a frequency of the respective AC current through the respective induction coil, wherein the first and second resonant converters have different resonance frequencies such that the resonance frequency of the first resonant converter is at least 1.4 times higher than the resonance frequency of the second resonant converter to prevent interference noise and flicker at a mains supply.

2. The induction hob according to claim 1, wherein frequency ranges (Δf1, Δf2) of the first and second resonant converters are different from each other and do not overlap.

3. The induction hob according to claim 1, wherein a frequency difference of at least 20 kHz between the frequency of the first AC current generated by the first resonant converter operating the first heating region at maximum power and the frequency of the second AC current generated by the second resonant converter operating the second heating region at a power of 40% of the maximum power of the first heating region is provided.

4. The induction hob according to claim 1, wherein a frequency difference of at least 20 kHz between the frequency of the first AC current generated by the first resonant converter operating the first heating region at maximum power and the frequency of the second AC current generated by the second resonant converter operating the second heating region at a minimum power is provided.

5. The induction hob according to claim 1, further comprising a controller configured to execute a software algorithm for keeping a frequency difference of the first and second AC currents powering the first and second heating regions out of an audible range.

6. The induction hob according to claim 1, wherein the first and second resonant converters are operated at different phases of a mains supply.

7. The induction hob according to claim 1, wherein the first and second heating regions are located next to each other.

8. The induction hob according to claim 1, wherein the output power of at least one of the first and second heating regions operated at resonance frequency is 4-15 times higher than the output power of at least one of the first and second heating regions operated at maximum frequency.

9. The induction hob according to claim 1, with at least three heating regions each powered by different types of resonant converters.

10. A method for operating an induction hob comprising at least two heating regions, each heating region comprising at least one induction coil, said method comprising:

driving a first AC current, by a first resonant converter, through a first induction coil of a first heating region, driving a second AC current, by a second resonant converter, through a second induction coil of a second heating region, controlling an output power of the first and second heating regions by varying a frequency of the respective AC current through the respective induction coil, characterized in that, wherein:

each resonant converter is operated such that a constant electric power flow through the respective induction coil is provided, and the first and second resonant converters have different resonance frequencies such that a resonance frequency of the first resonant converter is at least 1.4 times higher than the resonance frequency of the second resonant converter.

11. The method according to claim 10, wherein the output power of the first and second heating regions is adjusted by varying the frequency of the respective AC current through the respective induction coil according to a user demand.

12. The method according to claim 11, wherein a demanded output power of the first and second heating regions is obtained without varying the output power stepwise between different power levels.

13. The method according to claim 10, wherein the first resonant converter and the second resonant converter form a half-bridge resonant converter.

14. The method according to claim 13, wherein the half-bridge resonant converter comprises two switching circuits formed by two transistors and a resonant circuit formed by two capacitors and one of the first and second induction coils.

15. The method according to claim 14, wherein a resonance frequency of the half-bridge resonant converter is calculated with a formula:

$$f_{res} = \frac{1}{2\pi\sqrt{L(C1 + C2)}},$$

wherein L is an inductance value of one of the first and second inductor coils, and C1 and C2 are capacitance values of the two capacitors.

* * * * *